United States Patent [19]

Bielfeldt

[11] Patent Number: 5,044,269

[45] Date of Patent: Sep. 3, 1991

[54] CONTINUOUSLY WORKING PRESS

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 535,198

[22] Filed: Jun. 8, 1990

[30] Foreign Application Priority Data

Jun. 8, 1989 [DE] Fed. Rep. of Germany ..... 3918754

[51] Int. Cl.[5] ..... B30B 5/06; B30B 15/34

[52] U.S. Cl. ..... 100/38; 100/41; 100/93 P; 100/154; 156/583.5; 198/626.6; 198/833; 425/371

[58] Field of Search ..... 100/35, 41, 93 P, 38, 100/93 RP, 151, 153, 154; 156/555, 583.5; 264/120; 425/335, 371; 198/833, 626.6, 626.4

[56] References Cited

U.S. PATENT DOCUMENTS

| | | | |
|---|---|---|---|
| 1,659,733 | 2/1928 | Harbeck | 100/154 |
| 1,764,456 | 6/1930 | Mantius | 100/154 X |
| 2,075,735 | 3/1937 | Loomis . | |
| 2,142,932 | 1/1939 | Beard | 100/154 X |
| 3,120,862 | 2/1964 | Burger | 100/154 |
| 3,605,607 | 9/1971 | Gujer | 100/154 X |
| 3,860,368 | 1/1975 | Kerttula et al. | 425/371 X |
| 3,945,789 | 3/1976 | Boman | 425/371 |
| 3,981,666 | 9/1976 | Wadman | 425/371 |
| 4,311,550 | 1/1982 | Kerttula | 100/93 RP X |
| 4,375,350 | 3/1983 | Sato | 425/371 |
| 4,480,978 | 11/1984 | Gerhardt | 425/371 |
| 4,517,148 | 5/1985 | Churchland | 425/371 X |
| 4,613,293 | 9/1986 | Gerhardt | 425/371 |
| 4,621,999 | 11/1986 | Gerhardt | 425/371 |
| 4,636,345 | 1/1987 | Jensen et al. | 425/371 X |
| 4,647,417 | 3/1987 | Böttger et al. | 100/154 X |
| 4,718,843 | 1/1988 | Carlsson et al. | 100/93 RP X |
| 4,923,384 | 5/1990 | Gerhardt | 100/93 RP X |
| 4,994,138 | 2/1991 | Prihoda | 156/583.3 X |

FOREIGN PATENT DOCUMENTS

| | | | |
|---|---|---|---|
| 176349 | 3/1953 | Austria | 100/154 |
| 2037442 | 2/1972 | Fed. Rep. of Germany . | |
| 2222419 | 11/1972 | Fed. Rep. of Germany . | |
| 2343427 | 3/1975 | Fed. Rep. of Germany . | |
| 3312856 | 10/1984 | Fed. Rep. of Germany | 425/371 |
| 3133792 | 7/1985 | Fed. Rep. of Germany . | |
| 3735448 | 5/1989 | Fed. Rep. of Germany | 425/371 |
| 85838 | 11/1971 | German Democratic Rep. | 425/371 |
| 1151500 | 5/1969 | United Kingdom . | |

*Primary Examiner*—Harvey C. Hornsby
*Assistant Examiner*—Stephen F. Gerrity
*Attorney, Agent, or Firm*—Foley & Lardner

[57] ABSTRACT

A press is operable to form pressed materials such as fiberboard or chipboard. The press includes a press ram and a press platen facing one another to define a pressing region therebetween, and a plurality of rolling rods which support moving bands which draw the article through an entry region of the press and through the pressing region. An entry alignment device for the rolling rods includes first and second resilient pressure holding plates which impose a progressively increasing non-positive clamping force on the rolling rods as the rolling rods pass through the entry region, and first and second pilgrim-step mechanisms, each having a plurality of toothed members which are raised and lowered to periodically engage gaps formed between the rolling rods to impose a positive clamping force on the rods.

20 Claims, 4 Drawing Sheets

CONTINUOUSLY WORKING PRESS

BACKGROUND OF THE INVENTION

1. Field of the Invention

The invention relates to a continuously working press, and, more particularly, to a continuously working press for the production of chipboards, fiberboard, plastic boards, plywood boards or the like.

Such presses typically include flexible, endless steel bands which transmit the pressing force and draw the article to be pressed through the press and which are supported with an adjustable press nip against abutments of a press platen and a press ram via co-rotating rolling rods guided with their axes transverse relative to the running direction of the band. The rolling rods are typically introduced in the entry region orthogonally relative to the longitudinal center of the press and into the pressing region by plate-link chains and by introduction devices.

2. Discussion of the Related Art

In the known press according to German patent specification No. 3,152,911, (see U.S. Pat. No. 4,480,978), the introduction device consists of a plurality of rotating roller chains which are distributed at a distance from one another over the width of the sheet-steel press bands, the rolling rods being mounted in the entry region in the manner of rolling bearings on the rollers of the roller chains.

A disadvantage of this rolling-rod introduction device is that, when the rolling rods are permanently aligned at an exact distance from one another, an overloading of the roller chains and consequently a differing extension of the chainlink plates occur. As a result of this the rolling rods are no longer at an exact distance from one another during the entry into the high-pressure region. A run-on of the rolling rods and their destruction could be the consequence. Furthermore, the directing forces of the rollers which act permanently on the rolling rods give rise to a partial wear on the rolling rods and in the joints of the roller chains. The wear in the joints results in a greater play. But because of this, an exact alignment of the rolling rods which occurs when a predetermined distance between them being maintained, is lost. This is because, with increasing age, the roller chains have a different pitch division, and therefore, the alignment of the rolling rods with an exact gap spacing depends on the counterpressure resulting from the article to be pressed.

Another disadvantage is that the roller chains cool during the return outside of the heating plates. At different temperatures between the two outer chain introduction points (on the left and right), an orthogonal entry is thus disrupted by different chain extensions caused by thermal expansion of the roller chains. Moreover, in the region of positive introduction beginning from the start of the entry tangent, the roller chains undergo an elongation as a result of an increase of temperature. This elongation partially brings about a higher rolling speed in this region than the usual speed of 0.5 × the steel-band speed. This partial acceleration likewise leads to wear on the roller chains and rolling rods, creating a further adverse effect on the surface of the pressed boards from striation.

SUMMARY OF THE INVENTION

An object on which the invention is based is to provide a continuously working press, in which the introduction devices do not exert any permanent and identical directing forces on the rolling rods in the entry region of the press platen and press ram, but instead build up an adjustable and controllable pressure mosaic, and in which the introduction device gives the rolling rods a sufficient degree of freedom for axial self-stabilization.

In accordance with one aspect of the invention, a continuously working press includes a press ram and a press platen defining an adjustable press nip located in a pressing region positioned therebetween. First and second endless steel bands, respectively guided about the press platen and the press ram by driving drums and press drums, transmit a pressing force to an article to be pressed and draw it through the press. A plurality of corotating rolling rods support the steel bands as they travel through the press and have axes of rotation transverse to a running direction of the steel bands. Plate link chains and introduction devices guide the rolling rods orthogonally relative to a longitudinal center of the press through an entry region of the press and into the pressing region. First and second resilient pressure holding plates are located in the entry region adjacent the press platen and the press ram, respectively, and impose a progressively increasing pressure on the rolling rods as the rolling rods pass through the entry region. In addition, first and second pilgrim-step mechanisms are located in the entry region and are associated with the press platen and the press ram, respectively. Each of the pilgrim step mechanisms includes a plurality of toothed members which are raised and lowered to periodically engage V-shaped gaps formed between the rolling rods, whereby the rolling rods are periodically aligned by the positive clamping force imposed thereon by the pilgrim-step mechanisms.

In accordance with another aspect of the invention, a plurality of pairs of pilgrim-step mechanisms are arranged over the lengths of the rolling rods. Each pair of pilgrim-step mechanisms cooperates with one another to alternately engage the rolling rods as a tandem mechanism over an extended sign curve in the range of approximately twice 60°, making a total curve of approximately 360°.

In accordance with yet another aspect of the invention, heating means are provided for heating the first and second pressure holding plates to a uniform temperature.

In accordance with still another aspect of the invention, spring elements elastically support the toothed members within the pilgrim-step mechanisms.

Another object of the invention is to provide a method of aligning rolling rods of a continuously working press as they are conveyed through the press, the press comprising a press platen and a pressing ram defining a pressing region therebetween, and a pair of endless bands which are supported by the rolling rods and which draw an article through the press and transmit a pressing force to the article.

In accordance with one aspect of the invention, the inventive method includes the steps of introducing the rolling rods into an entry region of the press orthogonally relative to a longitudinal center of the press, and then applying non-positive clamping forces along the lengths of the rolling rods that progressively increases as the rolling rods travel through the entry region. The method also includes raising and lowering toothed members of pilgrim-step mechanisms into periodic engagement with gaps formed between the rolling rods as they travel through the entry region, whereby the rolling rods are periodically aligned by the positive clamping force imposed thereon by the pilgrim-step mechanisms. A final step includes conveying the rolling rods through the pressing region.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

An exemplary embodiment of the invention is described in detail below and illustrated in the accompanying drawings, wherein.

DETAILED DESCRIPTION OF THE PREFERRED EMBODIMENTS

Figure 1:
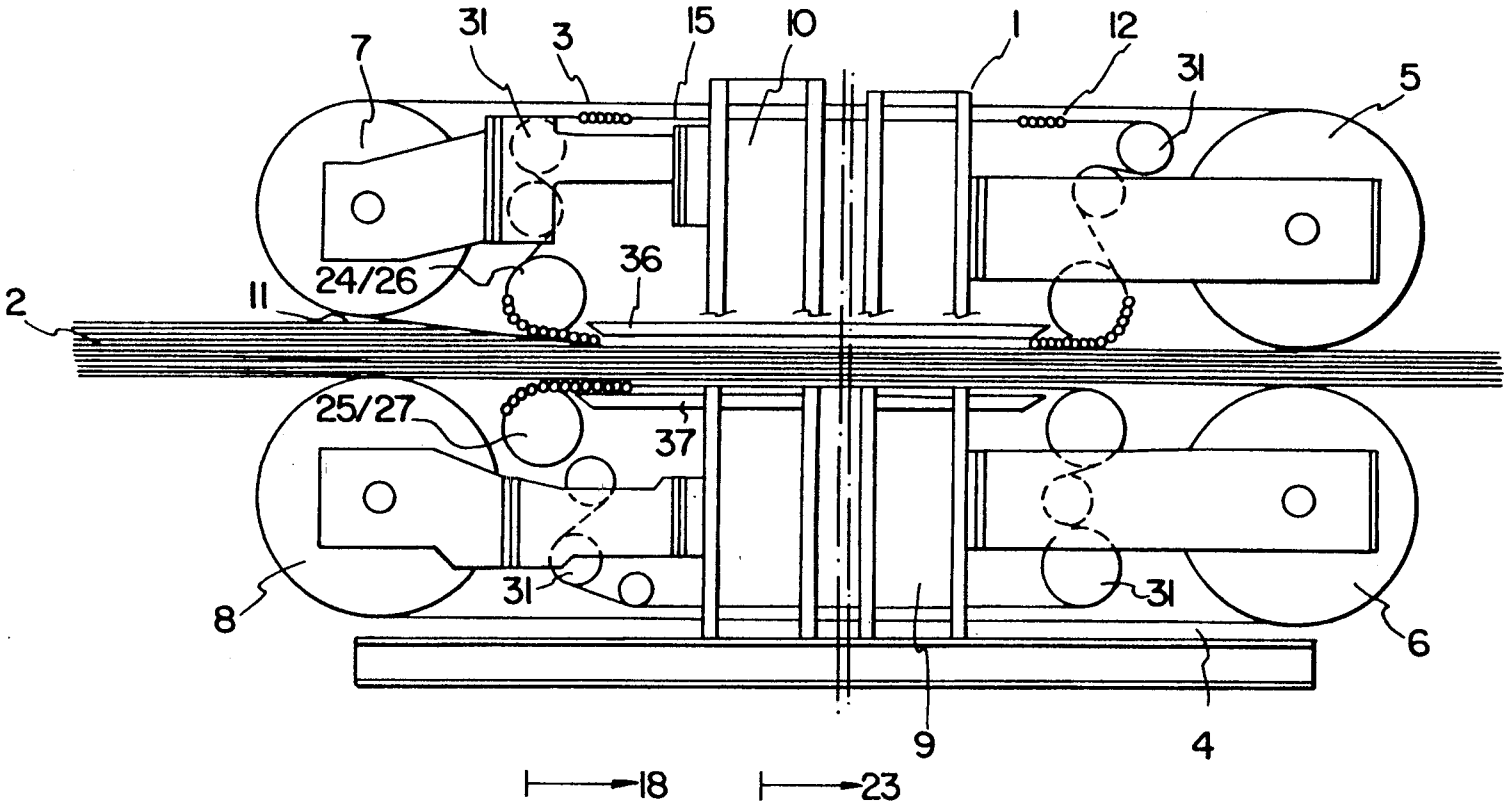
FIG. 1 shows a side view of a press according to the invention in a diagrammatic representation.

The advantages of the invention are especially that the alignment of the rolling rods with a uniform mutual gap spacing, absolutely straight and exactly at right angles to the working direction, is obtained periodically by pilgrim-step mechanisms with a non-positive connection of controlled force. The alignment is obtained permanently by resilient pressure holding plates designed with a metered and controlled non-positive connection and with an increasing pressure.

The alternate non-positive and discontinuous positive interconnection of the rolling rods in the alignment device is a precondition for a constraint-free alignment of the rolling rods because the rolling rods are free of constraint in terms of thermal expansion in the non-positive connection of controlled force. This interconnection is also a precondition because different pressure topographies during uncontrolled deformations of the steel bands do not have a negative effect on the rolling rods because of the resilient pressure holding plates. Moreover, if different rolling movements as a result of different rolling-friction resistances in the entry region, brought about by initially different lubricating conditions or temperatures, lead to partially unequal distances between the rolling rods, the rolling rods are corrected into the appropriate rolling position by the periodic action of the pilgrim-step mechanisms.

From the entry tangent, the rolling rods are introduced into a sprung pressure device by the introduction gearwheels with an increasing pressure trend brought about by a metered and controlled non-positive connection.

To prevent thermal stresses and therefore differing extensions, the entire system of the entry alignment device is maintained at a uniform operating temperature by a heating means.

The brief contact of the rolling rods by the meshing elements is necessary and advantageous in technological terms. This is because, if the pilgrim-step mechanism is, for example, at a uncontrolled lower operating temperature than the rolling rods, a linear heat abstraction can have an adverse effect on the article to be pressed. In the manufacture of chipboards, for example, this can lead to striation on the surface of the chipboard.

According to FIGURE the continuously working press 1 consists of a press platen 9, a movable press ram 10 and tension columns (not shown) connecting these. To adjust the press nip 11, the press ram 10 is moved up and down by hydraulic piston/cylinder arrangements (not shown) and is then retained in the selected position. Steel bands 3 and 4 are respectively guided round the press platen 9 and the press ram 10 via driving drums 5, 6 and deflecting drums 7, 8.

To prevent thermal stresses and therefore different extensions, the entire system of the entry alignment device is maintained at a uniform operating temperature by providing a heating means, which in this case comprises heating plates 36 and 37 attached to the press platen 9, the press ram 10 and the rotating steel bands 3 and 4. To reduce the friction between the heating plates 36 and 37 and the rotating steel bands 3 and 4, a rotating rolling-rod carpet formed from rolling rods 12 is provided in each case. The rolling rods 12, the axes of which extend transversely relative to the band run-through direction, i.e. the direction of motion of the bands, are joined together on the two longitudinal sides of the press 1 in plate-link chains 15 of predetermined pitch division. The rolling rods 12 roll between the heating plates 36 and 37 of the press ram 10 and press platen 9, on the one hand, and on the steel bands 3 and 4, on the other hand. The rolling rods help the steel bands 3 and 4 take up the article 2 to be pressed and to guide it through the press 1.

Figure 2:
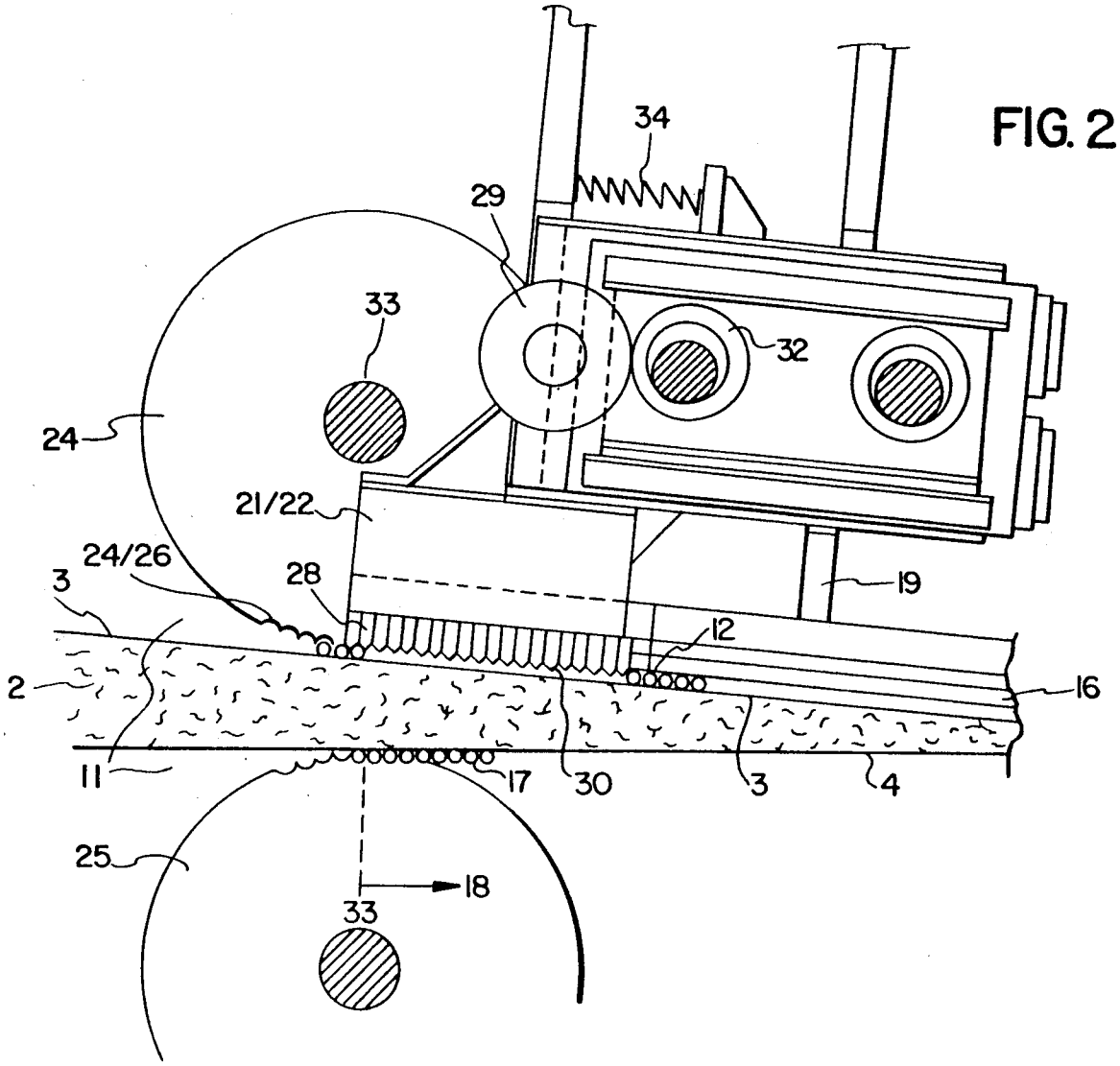
FIG. 2 shows a rolling-rod introduction device in the entry region.
Figure 3:
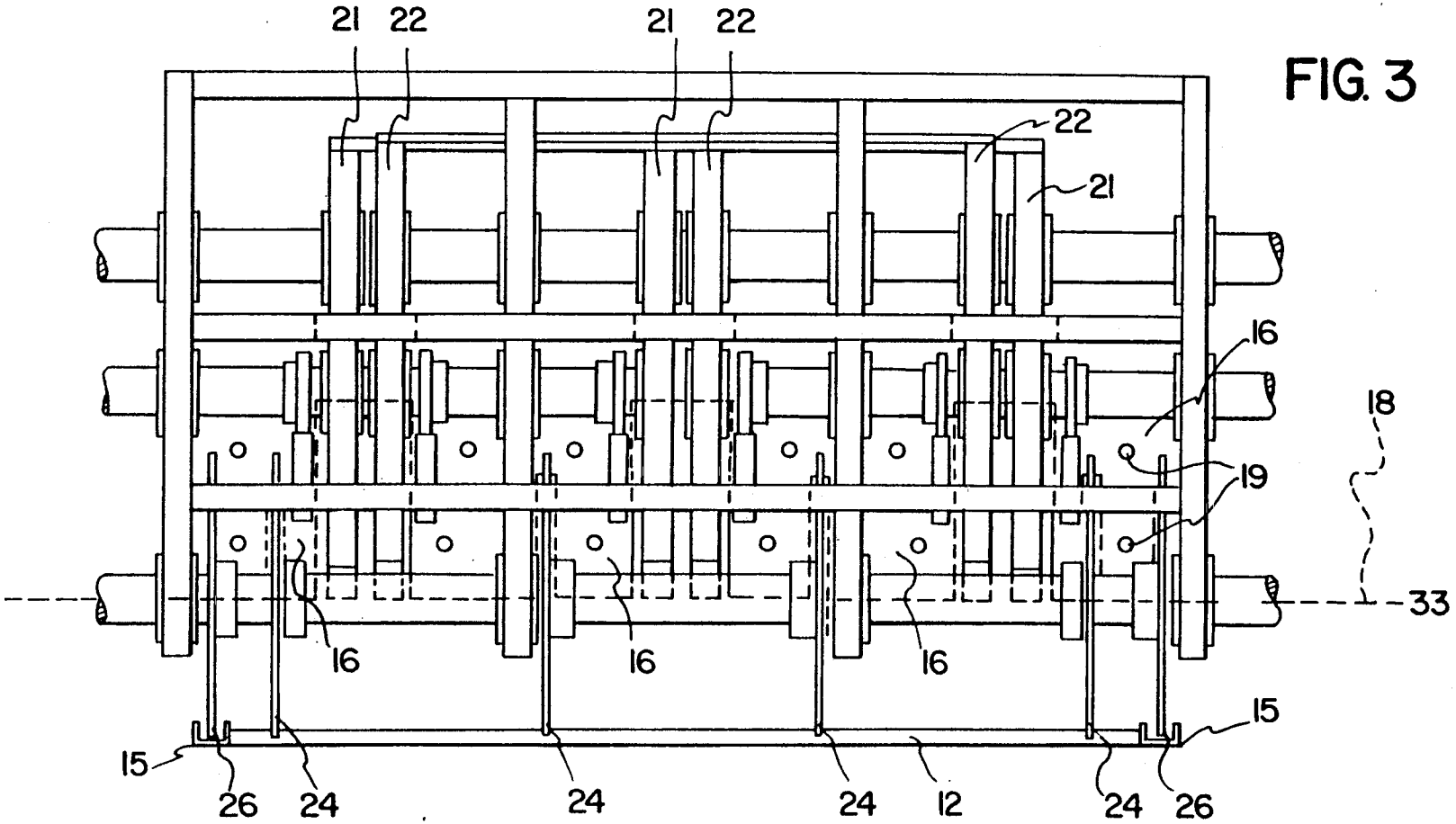
FIG. 3 shows a top view of the rolling-rod introduction device according to FIG. 2.

As further illustrated in FIGS. 1–4, the rolling rods 12 are introduced positively and nonpositively into the horizontal press plane by introduction gearwheels 24 and 25 and the plate-link chains 15 by two entry gearwheels 26 and 27 arranged laterally relative to the entry heating plate. The introduction gearwheels 24 and 25 are fastened to the press ram 10 and the press platen 9 respectively, and the entry gearwheels 26 and 27 are fastened to the press ram 10 and the press platen 9 respectively, each on an axle (FIG. 3). Reference numeral 18 denotes the start of the entry region of the rolling rods 12 into the press zone, and numeral 23 denotes the end and start, i.e. the length, of the high-pressure pressing region. Reference numeral 33 designates the entry tangent of the introduction gearwheels 24 and 25 and therefore the point where the rolling rods 12 first make contact with the steel bands 3 and 4 of the press platen 9 and press ram 10. The rolling-rod rotation in the press platen 9 and press ram takes place via the deflecting rollers 31.

Preferably, within the pressure device for a non-positive introduction over the length of the rolling rods, a plurality of pilgrim-step mechanisms 21 and 22 are used to assist in ensuring a periodic positive alignment, the positive alignment force effect being greater than the non-positive pressure forces of the sprung pressure device which act on the rolling rods 12. The pilgrim-step mechanisms 21 and 22 also may assist the resilient pressure holding plates (described below) by taking effect only on the outside, and if appropriate, from the outside inwards and with increasing pressure from the entry tangent to the high-pressure zone.

As illustrated in FIGS. 2 and 3, the rolling rods 12 are corrected into the appropriate rolling position for exact alignment with an identical gap spacing as a result of the periodic action of the pilgrim-step mechanisms 21 and 22. For the sake of convenience, these are shown only in the press ram 10. However, they are also present in the press platen 9. The pilgrim-step mechanisms 21 and 22 may be used in a tandem arrangement, if necessary.

The pilgrim step mechanisms are driven by double crank mechanisms comprising rotating pressure rollers 29 which raise and lower the toothed racks 28 via a cam disk 32. As illustrated in FIG. 2, each of the toothed racks 28 thereby penetrate with the tooth tip 30 into the V-shaped gap 17 between two rolling rods 12. The double crank mechanisms are supported elastically in the press frame by means of springs 34. Crank mechanisms drive the pilgrim-step mechanisms and may form a tandem mechanism, i.e, the double crank mechanism. The crank mechanisms each take effect over an extended sine curve in the range of approximately twice 60°, making a total of 360° over a contact time of approximates 0.5 seconds. The meshing of the toothed alignment racks 28 and the tooth tips 30 of these crank mechanisms is at the same time supported elastically via the springs 34, so that it is possible to elastically compensate for slight concave or convex deformations of the steel band which the sprung pressure device and the rolling rods 12 follow. The meshing elements 30 are designed exchangeably and are produced from softer material than the rolling rods 12, so that wear affects these parts before the rolling rods.

Figure 4:
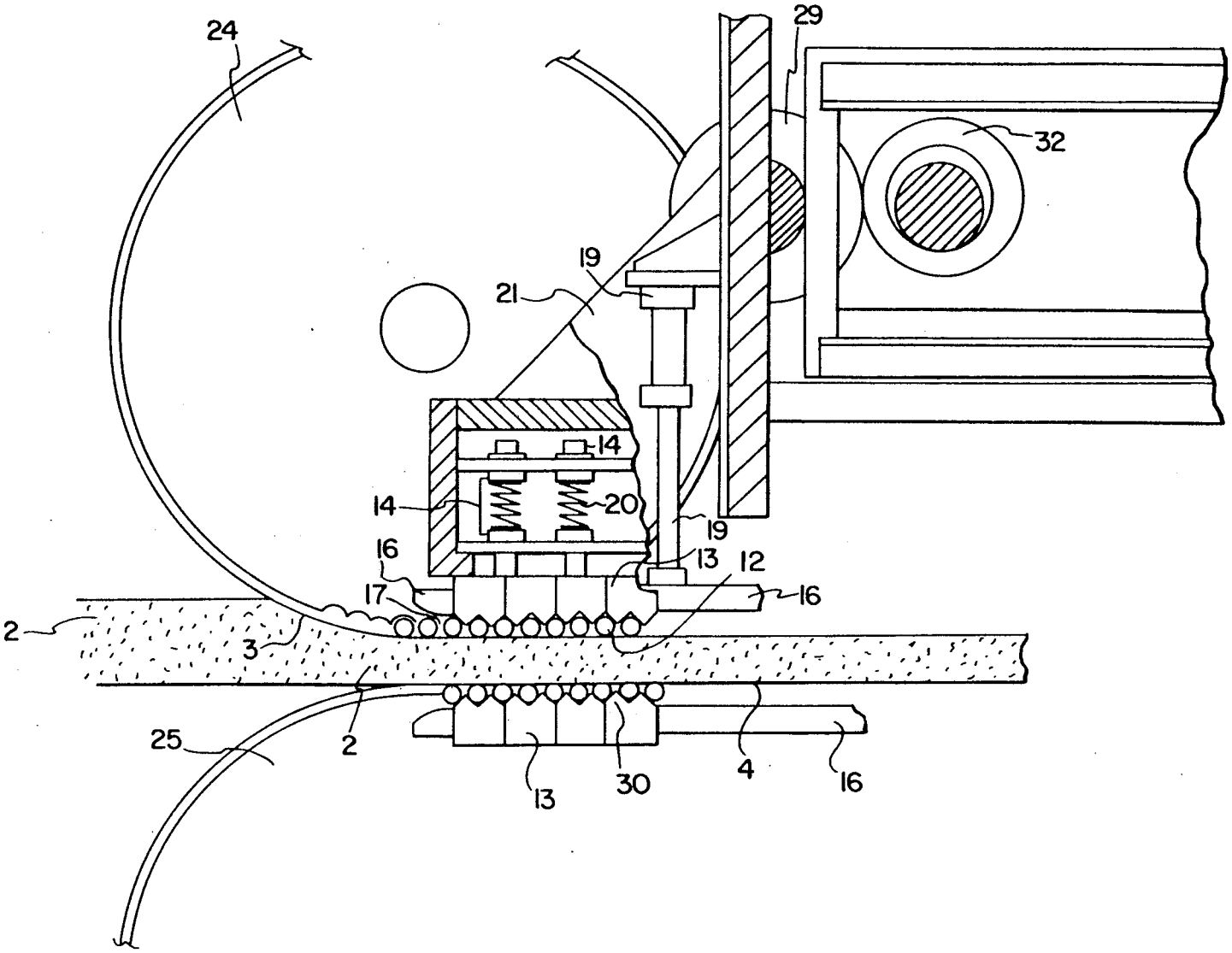
FIG. 4 shows a second embodiment of the rolling-rod introduction device.

In a second embodiment according to FIG. 4, the toothed racks 28 are composed of a plurality of directing elements 13 and constitute a pressure device 14. These directing elements are biased either mechanically or hydraulically in the pilgrim-step mechanisms 21 and 22, and, if appropriate, are biased via adjustable spring elements 20.

From the entry tangent 33, the rolling rods 12 are introduced by the introduction gearwheels 24 and 25 into a sprung pressure device with an increasing pressure trend into the press region. According to FIG. 3, the resilient pressure device consists of a pressure holding plate 16 which acts on the rolling rods 12 by means of adjustable spring elements or hydraulically controllable adjusting members 19, with the exception of the cutouts intended for the pilgrim-step mechanisms 21 and 22, if appropriate over their entire length. From the entry tangent 33, the rolling rods 12 are also subjected over the length by the pressure holding plates 16 to a permanent non-positive clamping taking place from the outside inwards with decreasing pressure.

At the same time, the controlled pressure trend is controlled via adjustable spring elements or the hydraulic adjusting members 19 in such a way that the controlled clamping force will initially mainly act only on the outside ends of the rolling rods 12 in the entry tangent 33 via the flexible pressure holding plate 16, with the pressing force at the longitudinal center of the pressure holding plate 16, being zero. To assist the clamping pressure initially acting only on the outside of the rolling rods 12, the flexible pressure holding plate 16 can have a parabolic free cutout centrally, so that not even any insignificant force effect can take place in the middle of the rolling rods 12. These measures are decisive for an orthogonal guidance of the rolling rods 12 in the entry region 18 and their orthogonal transfer at an exact spacing into the high-pressure zone 23.

What is claimed is:

1. A continuously working press comprising:

(A) a press ram and a press platen defining an adjustable press nip located in a pressing region positioned therebetween;

(B) first and second endless steel bands adapted to transmit a pressing force to an article to be pressed and to draw said article through said press;

(C) driving drums and deflection drums adapted to guide said first and second endless steel bands around said press platen and said press ram, respectively;

(D) a plurality of co-rotating rolling rods adapted to support said steel bands as they travel through said press, said rolling rods having axes of rotation transverse to a running direction of said steel bands;

(E) plate link chains and introduction devices adapted to guide said rolling rods orthogonally relative to a longitudinal center of said press through an entry region of said press and into said pressing region;

(F) first and second resilient pressure holding plates located in said entry region adjacent said press platen and said press ram, respectively, and adapted to impose a progressively increasing pressure on said rolling rods as said rolling rods pass through said entry region; and (G) first and second pilgrim-step mechanisms located in said entry region and associated with said press platen and said press ram, respectively, each of said pilgrim step mechanisms comprising a plurality of toothed members which are adapted to be raised and lowered to periodically engage V-shaped gaps formed between said rolling rods, whereby said rolling rods are periodically aligned by the positive clamping force imposed thereon by said pilgrim-step mechanisms.

2. A continuously working press as claimed in claim 1, wherein a plurality of pairs of said pilgrim-step mechanisms are arranged over the lengths of said rolling rods, each pair of pilgrim-step mechanisms cooperating with one another to alternately engage said rolling rods as a tandem mechanism over an extended sine curve in the range of approximately twice 60°, making a total curve of approximately 360°.

3. A continuously working press as claimed in claim 2, wherein said first and second pressure holding plates extend the width of said entry region, and further comprising a plurality of controllable adjusting members cooperating with each of said pressure holding plates and adapted to resiliently support the respective plate along its entire width.

4. A continuously working press as claimed in claim 3, wherein the force imposed on said rolling rods by said pilgrim-step mechanisms is greater than that imposed by said pressure holding plates.

5. A continuously working press as claimed in claim 2, wherein each of said adjusting members comprises a hydraulic adjusting member.

6. A continuously working press as claimed in claim 2, wherein each of said adjusting members comprises an adjustable spring element.

7. A continuously working press as claimed in claim 2, wherein said adjusting members are adapted to impose a force along the widths of said pressure holding plates that decreases from the lateral edges inward, whereby a non-positive clamping force is imposed on said rolling rods that decreases from the ends of each of said rods towards a middle thereof.

8. A continuously working press as claimed in claim 1, further comprising heating means for heating said first and second pressure holding plates to a uniform temperature.

9. A continuously working press as claimed in claim 1, further comprising spring elements adapted to elastically support said toothed members within said pilgrim-step mechanisms.

10. A press, comprising:

(A) a press ram and a press platen facing one another to define a pressing region therebetween;

(B) band means for drawing an article to be pressed through said press and for transmitting a pressing force to said article;

(C) a plurality of rolling rods adapted to support each of said band means as it draws said article through an entry region of said press and through said pressing region; and (D) an entry alignment device including means for guiding said rolling rods orthogonally relative to a longitudinal center of said press through an entry tangent and said entry region and into said pressing region, first and second resilient pressure holding plates located in said entry region adjacent said press platen and said press ram, respectively, and adapted to impose a progressively increasing pressure on said rolling rods as said rolling rods pass through said entry region, and first and second pilgrim-step mechanisms located in said entry region and associated with said press platen and said press ram, respectively, each of said pilgrim step mechanisms comprising a plurality of toothed members which are adapted to be raised and lowered to periodically engage gaps formed between said rolling rods, whereby said rolling rods are periodically aligned by the positive clamping force imposed thereon by said pilgrim-step mechanisms.

11. The press of claim 10, wherein said first and second pressure holding plates extend the width of said pressing region, and further comprising a plurality of controllable adjusting means for resiliently supporting said first and second pressure holding plates along their entire widths.

12. The press of claim 11, wherein said adjusting means impose a force along the widths of said pressure holding plates that decreases from the lateral edges inward, whereby a non-positive clamping force is imposed on said rolling rods that decreases from the ends of each of said rods towards a middle thereof.

13. The press of claim 10, further comprising heating means for heating said entry alignment device to a uniform temperature.

14. The press of claim 13, wherein said heating means comprises a pair of heating plates.

15. The press of claim 10, further comprising spring means for elastically supporting said toothed members within said pilgrim-step mechanisms.

16. A method of aligning rolling rods of a continuously working press as they are conveyed through said press, said press comprising a press platen and a pressing ram defining a pressing region therebetween, and a pair of endless bands which are supported by said rolling rods and which draw an article through said press and transmit a pressing force to said article, said method comprising the steps of:

(A) introducing said rolling rods into an entry region of said press orthogonally relative to a longitudinal center of said press; then (B) applying non-positive clamping forces along the lengths of said rolling rods that progressively increases as said rolling rods travel through said entry region;

(C) raising and lowering toothed members of pilgrim-step mechanisms into periodic engagement with gaps formed between said rolling rods as they travel through said entry region, whereby said rolling rods are periodically aligned by the positive clamping force imposed thereon by said pilgrim-step mechanisms; and then (D) conveying said rolling rods through said pressing region.

17. The method of claim 16, further comprising the step of adjusting said non-positive clamping forces.

18. The method of claim 16, wherein the step of imposing non-positive clamping forces on said rolling rods comprises the step of imposing clamping forces that are initially greater at the ends of said rolling rods than at the centers thereof.

19. The method of claim 16, wherein the step of periodically imposing a force on said rolling rods by said pilgrim-step mechanism includes imposing a force that is greater than said nonpositive clamping forces.

20. The method of claim 16, wherein the alignment of said rolling rods is performed by an alignment device which includes said pilgrim-step mechanism, and further comprising the step of heating the entire alignment device to a uniform temperature.

* * * * *